US008425206B2

(12) United States Patent
Rosenkranz et al.

(10) Patent No.: US 8,425,206 B2
(45) Date of Patent: Apr. 23, 2013

(54) PUMP INSERT

(75) Inventors: Kerstin Rosenkranz, Oberursel (DE); Matthias Wendt, Neu Anspach (DE)

(73) Assignee: ixetic Bad Homburg GmbH, Bad Homburg (DE)

( * ) Notice: Subject to any disclaimer, the term of this patent is extended or adjusted under 35 U.S.C. 154(b) by 411 days.

(21) Appl. No.: 12/678,958

(22) PCT Filed: Aug. 19, 2008

(86) PCT No.: PCT/DE2008/001367
§ 371 (c)(1), (2), (4) Date: Mar. 18, 2010

(87) PCT Pub. No.: WO2009/036723
PCT Pub. Date: Mar. 26, 2009

(65) Prior Publication Data
US 2010/0239450 A1 Sep. 23, 2010

(30) Foreign Application Priority Data
Sep. 19, 2007 (DE) ..... 10 2007 044 999

(51) Int. Cl.
*F04B 17/00* (2006.01)
*F04C 18/00* (2006.01)

(52) U.S. Cl.
USPC ..... 417/360; 418/259

(58) Field of Classification Search ..... 417/360, 417/410.3–410.5
See application file for complete search history.

(56) References Cited

U.S. PATENT DOCUMENTS

| | | | | |
|---|---|---|---|---|
| 4,373,871 | A * | 2/1983 | Christ | 417/310 |
| 4,770,612 | A * | 9/1988 | Teubler | 417/300 |
| 4,772,190 | A * | 9/1988 | Merz et al. | 418/133 |
| 6,478,559 | B2 * | 11/2002 | Bishop et al. | 418/133 |
| 6,481,990 | B2 * | 11/2002 | Wong et al. | 418/82 |

FOREIGN PATENT DOCUMENTS

| | | | |
|---|---|---|---|
| DE | 41 37 279 | A1 | 5/1993 |
| DE | 196 32 024 | A1 | 2/1998 |
| GB | 2316128 | A | 2/1998 |
| WO | WO 2005/001246 | A | 1/2005 |

* cited by examiner

*Primary Examiner* — Charles Freay
(74) *Attorney, Agent, or Firm* — Davidson, Davidson & Kappel, LLC

(57) ABSTRACT

A pump insert of a vane-type pump having no dedicated housing, the insert being inserted in a gear housing.

17 Claims, 1 Drawing Sheet

PUMP INSERT

BACKGROUND

The present invention relates to a pump insert of a vane-type pump without its own housing. Pump inserts of this kind are used in a wide variety of fields of application in already existing machine housings, such as, for example, in transmission housings of motor vehicles or in other housings where a hydraulic supply is required. However, it is disadvantageous that the fastenings, constituted of screws, covers or the like, that are used for the pump insert in the corresponding housings, are costly, space-consuming and complex.

SUMMARY OF THE INVENTION

It is, therefore, an object of the present invention to devise a pump insert of a vane-type pump that will overcome these problems.

An object of the present invention is to provide a pump insert of a vane-type pump without its own housing that is used in a transmission housing, for example, of a motor vehicle, the pump insert having a first pressure plate, a contour ring, a rotor, a drive shaft, which drives the rotor, vanes, and a second pressure plate, and is axially secured in position in the transmission housing at the second pressure plate by a retaining ring.

An advantage of the present invention is there is no need for a second transmission housing part, such as a cover, for example, or for expensive fastening means, such as screw connections or the like. Another advantage is derived in that, due to the retaining ring installed in the transmission housing and at the second pressure plate, no axial forces act on an additional housing component; rather, these forces act within one single housing component and thus not on a second housing component via connection points.

A pump insert according to the present invention has the distinguishing feature that the first pressure plate is axially pressed by a pressure field against the contour ring, and against the second pressure plate and the retaining ring.

Here, the benefit is derived that the contact pressures of the pressure field keep any leakage within the pump insert to a minimum and ensure a secure contact-making on the retaining ring, thereby effecting a good sealing action and a pump insert operation that is characterized by little play.

A pump insert is also preferred where the pressure field has an annular form. In addition, a pump insert is preferred where the annular pressure field extends from the outer circumference of the first pressure plate radially inwardly.

Here the advantage is derived that the contact pressures of the pressure field act outwardly at the first pressure plate via the lifting ring on the outer circumference of the second pressure plate, thereby avoiding a bending under load in the inner radial portion of the pump insert, which, in some instances, would lead to deformation and pinching.

Another pump insert according to the present invention has the distinguishing feature that the first pressure plate has two seals. A pump insert is also preferred where the first seal of the first pressure plate is configured radially outwardly at the periphery, and the second seal of the first pressure plate axially inwardly at the pressure field.

In addition, a pump insert is preferred where, in the unpressurized state, the second axially configured seal is effective as an axial preloading element and, in the unpressurized state, presses the pump insert against the retaining ring.

Here the advantage is derived that the pump insert is already effectively sealed in the unpressurized state and exhibits small gaps, making it possible to avoid starting problems caused by leakage.

A pump insert according to the present invention has the distinguishing feature that the axial seal is designed as a combination seal that is composed of a sealing and a supporting element. In addition, it is conceivable for separate spring devices to be provided that press the pump insert against the retaining ring.

Another pump insert according to the present invention has the distinguishing feature that the second pressure plate has a radial seal on the outer circumference thereof that seals against the transmission housing. A pump insert is also preferred where the second pressure plate has a shaft sealing ring in the bearing area of the shaft.

A pump insert according to the present invention also has the distinguishing feature that the support geometry for the retaining-ring groove is implemented in the transmission housing, and the contact surface at the second pressure plate is designed to be self-restraining. In particular, the angles in the supporting area of the retaining ring differ from one another essentially by five degrees.

A pump insert is also preferred where the supporting angle in the housing is 25 degrees. A pump insert is also preferred where the supporting angle of the retaining ring at the second pressure plate is 30 degrees.

BRIEF DESCRIPTION OF THE DRAWINGS

The present invention is described with reference to the figures, which show.

DETAILED DESCRIPTION

Figure 1:
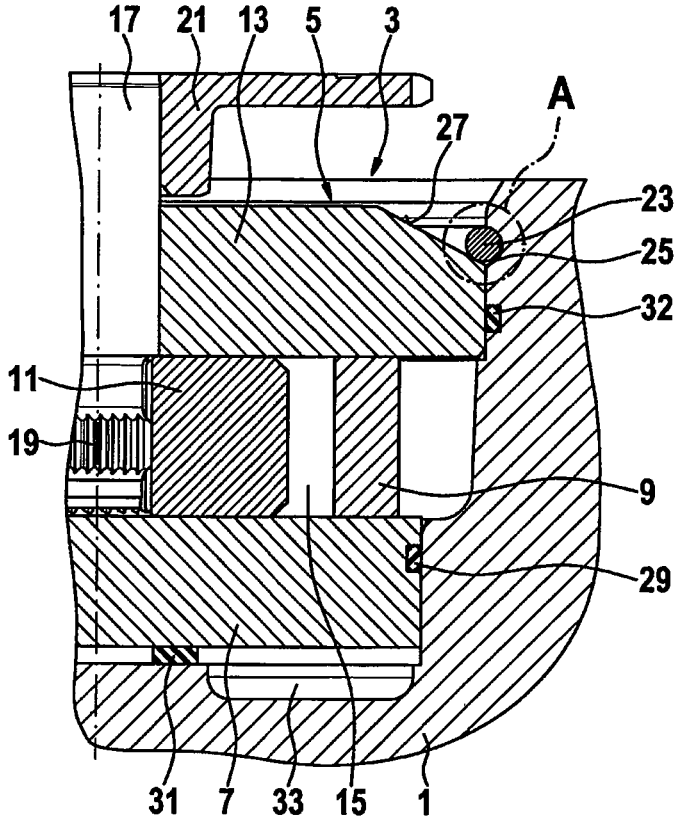
FIG. 1 a partial section of a pump insert according to the present invention in a transmission housing.

FIG. 1 shows a partial section through a transmission housing 1 having a pump insert 5 according to the present invention. A transmission housing 1 includes a stepped blind hole 3 in which pump insert 5 is configured. Pump insert 5 has a first pressure plate 7, a contour ring 9, a rotor 11 and a second pressure plate 13. Configured radially displaceably in slots of rotor 11 are vanes 15 which, in response to rotation of rotor 11, move by their upper vane edge along the contour of contour ring 9. Cells are formed between two adjacent vanes 15 in conformance with the contour of contour ring 9. Depending on the contour section, these cells increase or decrease in volume and, in the process, suction oil and discharge it again. Rotor 11 is driven by a drive shaft 17 by way of a toothing 19, in this case, drive shaft 17 being driven via a sprocket wheel 21 or, in some instances, via another drive element, such as toothed wheels or a belt drive. In this context, shaft 17 is cantilevered in second pressure plate 13. A bearing arrangement in both pressure plates would be likewise conceivable, however. Pump insert 5 is axially secured in position in transmission housing 1 by a retaining ring 23; in transmission housing 1, an approximately part-circular groove 25 being configured in which retaining ring 23 is located in position, while retaining ring 23 rests on an incline 27 on second pressure plate 13. First pressure plate 7 has a radial seal 29 and an axial seal 31 which seal a pressure field 33 between transmission housing 1 and first pressure plate 7. Thus, pressure field 33 extends from the radially outer periphery of first pressure plate 7 to the radially inner area delimited by sealing device 31. In the radially inner region of seal 31 about the axis of drive shaft 17, pressure plate 7 is not subject to pressure load, so that pressure field 33, which extends annularly around pressure plate 7, applies an axial force to contour ring 9 and second pressure plate 13, essentially in the outer region of pressure plate 7; second pressure plate 13 then being pressed against retaining ring 23 which, in turn, introduces the axial forces via housing groove 25 into transmission housing 1. Since, on the housing side, the axial forces only act within one component, namely transmission housing 1, and not, as under the related art, through multi-part housings having corresponding housing partitions which, under axial forces, may have expansion joints, a very good fastening of the pump insert is hereby provided, thereby minimizing any danger of deformation and misalignment of the pump insert in a corresponding housing. A misalignment of the pump insert could lead, for example, to acoustical problems and/or to a reduction in the bearing service life due to edge loads and/or to gaping of components and thus to leakage, respectively to degradation of the suction properties and/or to a reduced hydraulic efficiency due to the deformation of the pressure plates of the pump supported on the transmission housing.

Since the axial forces of pump insert 5 are transmitted at a considerable distance, namely at the periphery of pump insert 5, the deformation of pressure plates 7, 13 in the middle region of pump insert 5 is minimized. Also, retaining ring 23 makes possible a uniform transfer of forces at the periphery, so that smaller, more uniform deformations of the second pressure plate are made possible and misalignments of the pump parts are reduced. Thus, the inventive features of this pump insert 5 having the retaining ring installation lead to a simpler structural design of transmission housing 1 and to weight optimizations since fewer components are needed. Also, pressure plate 13 of pump insert 5 may have a smaller diameter design since the retaining ring makes it possible for the support to be manufactured with radially smaller dimensions than, for example, when screws or the like are used. Pump insert 5 is axially fixed in position in the unpressurized state, i.e., out-of-operation, when no axial pressure field is present in region 33, by sealing device 31, which is designed as an axially preloading element having a corresponding spring action. In this inventive variant of a pump insert 5 having the retaining ring fastening, pump insert 5 is pressed somewhat deeper into transmission housing 1 in order to install retaining ring 23. To that end, a corresponding deflection of sealing device 31 is provided. Therefore, in the case of sealing device 31, it may also be practical to use a combination seal, composed of a sealing element and a supporting element, in order to bridge the gap enlarged by the increased installation clearance.

Figure 2:
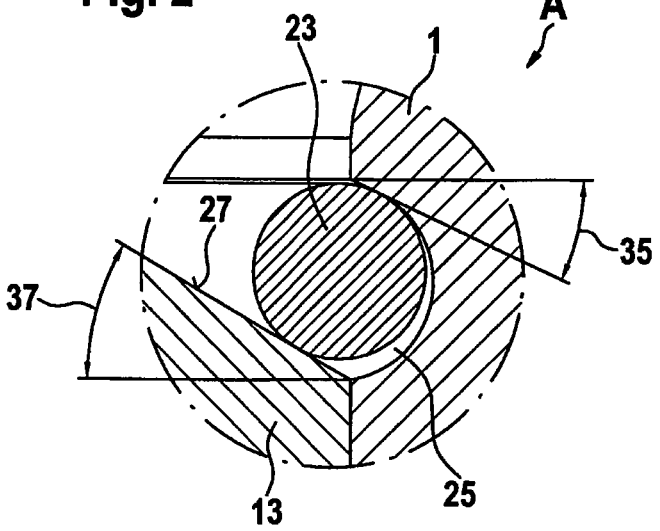
FIG. 2 the support geometry of the retaining ring in a magnified view.

In a magnified view in region A, FIG. 2 shows the geometry in the supporting area of retaining ring 23. The angles in the supporting area of retaining ring 23 are unequal in size in transmission housing 1 and on second pressure plate 13; in this case, they differ by about five degrees. Thus, retaining ring 23 engages in the approximately semicircular groove 25 of transmission housing 1 at an angle 35 of about 25 degrees, while it rests on incline 27 of second pressure plate 13 at an angle 37 of about 30 degrees. As a result, the supporting area of retaining ring 23 is designed to be self-restraining.

The design approach according to the present invention for a pump insert 5 for a transmission pump in a vane type of design is particularly useful in this application for fastening the pump in the transmission inexpensively and with minimized constructional outlay, given existing space requirements. Particularly advantageous in this context is the combination of a pump insert 5 without a pump housing, with axial force acting on one side via a pressure field and transfer of the axial force by a retaining ring.

List Of Reference Numerals

1 transmission housing
3 blind hole
5 pump insert
7 first pressure plate
9 contour ring
11 rotor
13 second pressure plate
15 vane
17 drive shaft
19 toothing
21 sprocket wheel
23 retaining ring
25 groove
27 incline
29 radial seal
31 axial seal
32 radial seal
33 pressure field
35 25 degree angle
37 30 degree angle

What is claimed is:

1. A pump insert of a vane-type pump without its own housing inserted in a transmission housing, the pump insert comprising:

a first pressure plate, a contour ring, a rotor, a drive shaft, vanes and a second pressure plate, the pump insert being axially secured in position in the transmission housing at the second pressure plate by a retaining ring, the second pressure plate including a hole passing completely therethrough, the drive shaft extending from outside of the transmission housing through the hole in the second pressure plate into the rotor, wherein the transmission housing and second pressure plate define a support geometry for the retaining ring, the support geometry being self-restraining, wherein the support geometry is defined by an inclined surface of the second pressure plate that is angled at a first angle with respect to a line perpendicular to an axis of the drive shaft, and a surface of the transmission housing that is angled at a second angle with respect to the line.

2. The pump insert as recited in claim 1 wherein the first pressure plate is axially pressed by a pressure field against the contour ring and toward the second pressure plate and the retaining ring.

3. The pump insert as recited in claim 2 wherein the pressure field has an annular form.

4. The pump insert as recited in claim 3 wherein the pressure field extends radially inward from an outer circumference of the first pressure plate.

5. The pump insert as recited in claim 2 wherein the first pressure plate has a first seal and a second seal.

6. The pump insert as recited in claim 5 wherein the first seal seals the pressure field radially outwardly on an outer circumference of the first pressure plate, and the second seal seals the pressure field axially inwardly on an axial surface of the first pressure plate.

7. The pump insert as recited in claim 6 wherein in an unpressurized state, as an axial preloading element, the second seal presses the pump insert against the retaining ring.

8. The pump insert as recited in claim 1 wherein the second pressure plate has a radial seal on an outer periphery.

9. The pump insert as recited in claim 1 wherein the second pressure plate has a shaft sealing ring in an area of a shaft bearing.

10. The pump insert as recited in claim 1 wherein the first and second angles differ from one another by five degrees.

11. The pump insert as recited in claim 10 wherein the second angle is 25 degrees.

12. The pump insert as recited in claims 10 wherein the first angle is 30 degrees.

13. The pump insert as recited in claim 1 wherein the second angle is greater than the first angle.

14. A pump insert of a vane-type pump without its own housing inserted in a blind hole of a transmission housing, the pump insert comprising:

a rotor having vanes;

a drive shaft for driving the rotor;

a contour ring circumferentially surrounding the rotor;

a first pressure plate on a first axial side of the rotor;

a second pressure plate on a second axial side of the rotor; and a retaining ring axially securing the pump insert in position in the blind hole at the second pressure plate, the first pressure plate being axially pressed by a pressure field away from an axial end of the blind hole and against the contour ring, wherein the transmission housing and second pressure plate define a support geometry for the retaining ring, the support geometry being self-restraining, wherein the support geometry is defined by an inclined surface of the second pressure plate that is angled at a first angle with respect to a line perpendicular to an axis of the drive shaft, and a surface of the transmission housing that is angled at a second angle with respect to the line.

15. The pump insert as recited in claim 14 wherein the second angle is greater than the first angle.

16. A pump insert of a vane-type pump without its own housing inserted in a transmission housing, the pump insert comprising:

a rotor having vanes;

a drive shaft for driving the rotor;

a contour ring circumferentially surrounding the rotor;

a first pressure plate on a first axial side of the rotor;

a second pressure plate on a second axial side of the rotor;

a retaining ring axially securing the pump insert in position in the transmission housing at the second pressure plate, the first pressure plate being axially pressed by a pressure field against the contour ring and toward the second pressure plate and the retaining ring;

an axial seal between the transmission housing and an axial surface of the first pressure plate axially preloading the first pressure plate against the contour ring; and a radial seal between a radial periphery of the first pressure plate and the transmission housing, the radial seal and the axial seal sealing the pressure field, wherein the transmission housing and second pressure plate define a support geometry for the retaining ring, the support geometry being self-restraining, wherein the support geometry is defined by an inclined surface of the second pressure plate that is angled at a first angle with respect to a line perpendicular to an axis of the drive shaft, and a surface of the transmission housing that is angled at a second angle with respect to the line.

17. The pump insert as recited in claim 16 wherein the second angle is greater than the first angle.

* * * * *